US008393470B2

(12) United States Patent
Philips

(10) Patent No.: US 8,393,470 B2
(45) Date of Patent: Mar. 12, 2013

(54) STACKING DRAWER PACKAGE

(75) Inventor: Nicholas A Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 793 days.

(21) Appl. No.: 12/140,515

(22) Filed: Jun. 17, 2008

(65) Prior Publication Data

US 2009/0308785 A1 Dec. 17, 2009

(51) Int. Cl.
*B65D 21/00* (2006.01)

(52) U.S. Cl. ..... 206/512; 206/464; 206/474; 229/147; 229/174; 229/178; 229/125.19

(58) Field of Classification Search ..... 206/512, 206/527, 476, 525, 464, 474; 229/147, 164, 229/174, 178, 103
See application file for complete search history.

(56) References Cited

U.S. PATENT DOCUMENTS

| | | | | |
|---|---|---|---|---|
| 1,824,927 | A * | 9/1931 | Powell | 229/150 |
| 2,790,589 | A | 4/1957 | Moore | |
| 2,944,717 | A * | 7/1960 | Lynch | 206/527 |
| 2,964,229 | A | 12/1960 | Mansfield | |
| 3,395,849 | A | 8/1968 | Gillam | |
| 3,398,000 | A | 8/1968 | Peters | |
| 4,265,393 | A | 5/1981 | Orchard | |
| 5,092,467 | A | 3/1992 | Elward | |
| 5,180,075 | A | 1/1993 | Montalbano | |
| 5,294,044 | A | 3/1994 | Clark | |
| 6,394,337 | B1 | 5/2002 | Ross et al. | |
| 6,729,533 | B2 * | 5/2004 | Wozniacki | 229/125.28 |
| 7,124,890 | B2 * | 10/2006 | McLeod et al. | 206/509 |
| 2003/0010816 | A1 * | 1/2003 | Jackson | 229/169 |
| 2005/0145687 | A1 * | 7/2005 | Conway | 229/174 |
| 2006/0186186 | A1 | 8/2006 | Kuhn | |
| 2009/0308779 | A1 | 12/2009 | Philips | |
| 2009/0308785 | A1 | 12/2009 | Philips | |

FOREIGN PATENT DOCUMENTS

| | | |
|---|---|---|
| DE | 2914882 | 10/1980 |
| DE | 9216430 U1 | 2/1993 |
| DE | 9207105 U1 | 6/1993 |
| GB | 1255476 | 12/1971 |
| GB | 2229426 | 9/1990 |
| WO | 2005000691 | 1/2005 |

* cited by examiner

*Primary Examiner* — J. Gregory Pickett
*Assistant Examiner* — Raven Collins
(74) *Attorney, Agent, or Firm* — Matthew M. Eslami

(57) ABSTRACT

A tray has a bottom panel, side and end panels and top shoulders at opposed ends of the tray. A separate cover extends across the top and down opposed sides of the tray. The cover has attachment tabs that extend into attachment slots in the tray. The trays may be stacked with an upper tray resting on the shoulders of the lower tray. The cover is a cover for the stack of trays with the side panels of the cover sized for different numbers of trays in the stack. One embodiment has stacking tabs extending above the tray. The cover has cut-outs to accommodate the stacking tabs.

6 Claims, 12 Drawing Sheets

STACKING DRAWER PACKAGE

This is directed to a container which may be stacked and which has a separate cover for one or multiple containers.

People often order more than one pizza when ordering take-out. Each of the pizzas are placed in a separate box having a cover. The packaging for these pizzas costs more.

In the present invention it is proposed to provide one cover for multiple pizzas. This reduces the amount of material required to ship the pizzas and the amount of material going to be discarded.

More specifically, the container of the invention comprises a bottom wall having opposite end edges and opposite side edges. Side walls having top and bottom edges and opposite ends are foldably joined to the side edges of the bottom wall and extend upwardly therefrom. Flaps on the ends of the side walls are folded inwardly perpendicular to the respective associated side wall to lie parallel to a respective adjacent end edge of the bottom wall, and cut outs are in each side wall adjacent but spaced from each end thereof and spaced from the top and bottom edges thereof. End walls having an upper edge are foldably joined to the end edges of the bottom wall and extend upwardly therefrom to lie against an outer surface of the flaps on the side walls. Shoulder panels foldably joined to the upper edges of the end walls extend inwardly therefrom in spaced parallel relationship to the bottom wall, and a side flap is foldably connected to each end of each shoulder panel, said side flaps being folded downwardly to lie against an outer surface of respective adjacent ends of the side walls in overlying relationship to said cut outs in said side walls. A locking tab is formed in each side flap spaced from adjacent edges of the side flaps, and the locking tabs are inserted through the cut outs to lock the side flaps and thus the shoulder panels, end walls and side walls in operative folded relationship.

A cut in each side wall at its bottom edge forms a slot immediately above the bottom wall.

A separate cover is applied to the container. The cover comprises a cover top panel lying on top of the shoulder panels in parallel spaced relationship to the container bottom wall, and cover side panels depend from opposite side edges of the cover top panel to overlie a respective side wall. Cover attachment flaps on bottom edges of the cover side panels are folded inwardly and extend through a respective slot at the bottom edge of each said side wall to hold said cover in place.

A plurality of the containers may be stacked on top of one another with the bottom wall of an upper container resting on the shoulder panels of a lower container. A separate cover may be placed on the stack of containers so that all the containers are under a single cover. Thus, the cover top panel overlies the uppermost container in the stack, and the side panels have a length to extend to the bottom of the lowermost container in the stack, with the cover attachment flaps being inserted in the slots in the lowermost container to hold the stack of containers and the cover in place.

In one embodiment, a cut adjacent and parallel to the folded connection between the shoulder panels and the side flaps forms a stacking tab on an upper edge of each side flap, with a stacking tab projecting upwardly beyond the shoulder panels at each corner of the container. A cut out in a bottom edge of each side flap is in position to be in registry with and receive a stacking tab on a subjacent container when the containers are stacked on top of one another. In this embodiment, slits in the separate cover are positioned to receive the stacking tabs.

Stacked individual containers with a single cover in accordance with the invention can function similarly to sliding drawers. Neither the drawers nor the separate cover incorporate any internal scrap (waste areas) which, if not removed during manufacture, could pose a human consumption risk when the package is used in conjunction with food contents. The system enables individual containers to be taken to separate eating places, and different containers in the stack may contain like or different contents, although they are all initially packaged together. Customers can use identical and common drawers to create packages that contain 1 to 10 (or more) drawers by simply using different sized covers. In the event that slidable drawers are not desired by the customer, containers with stacking tabs can be used to lock the containers together.

DETAILED DESCRIPTION OF THE INVENTION

While stacks of single, triple and quintuple containers are shown it should be understood that the covers can be sized to fit any number of containers in a stack.

Throughout the application the term "attachment line" is used to denote score lines, reverse score lines and slit and score lines.

Figure 1:
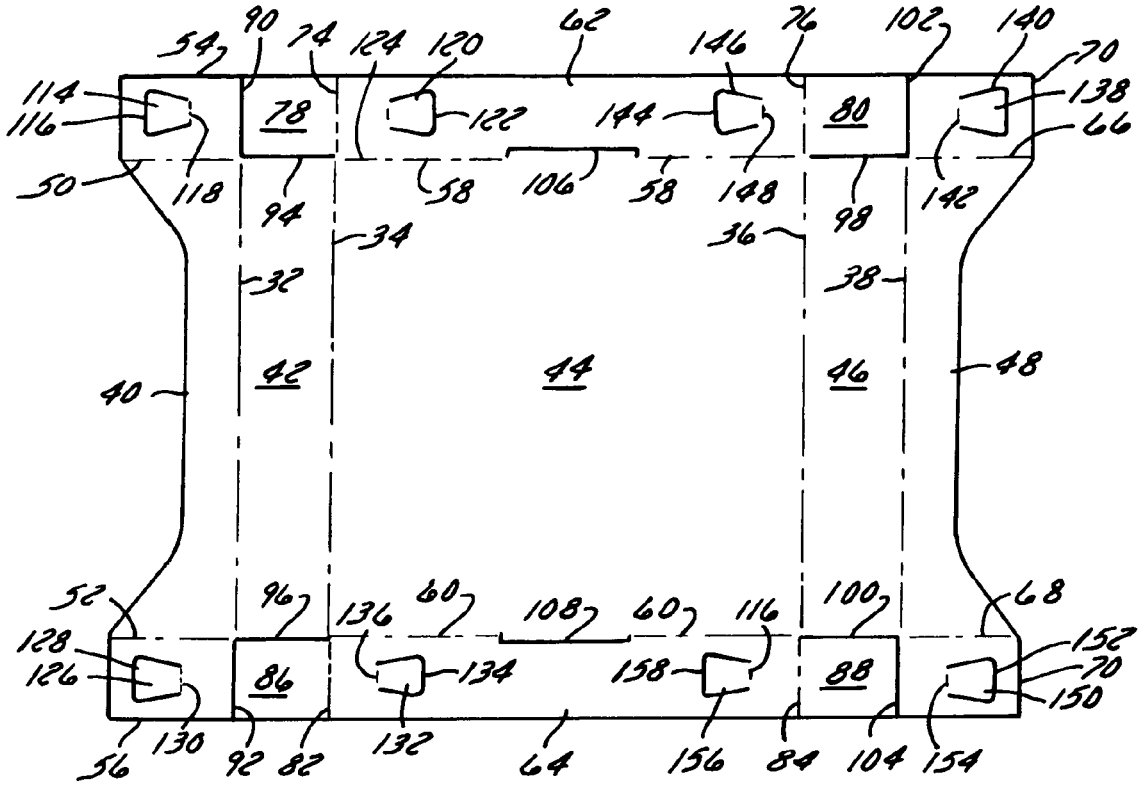
FIG. 1 is a top plan view of one embodiment of a blank for a pizza container.
Figure 2:
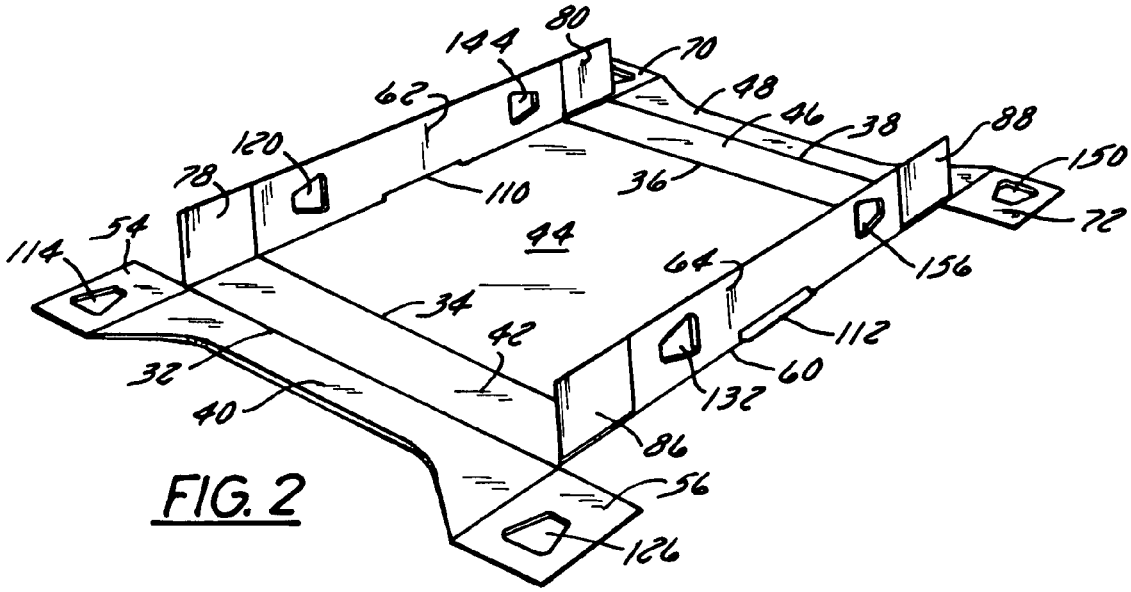
FIGS. 2-6 are isometric views showing the formation of the container from the blank of FIG. 1.
Figure 3:
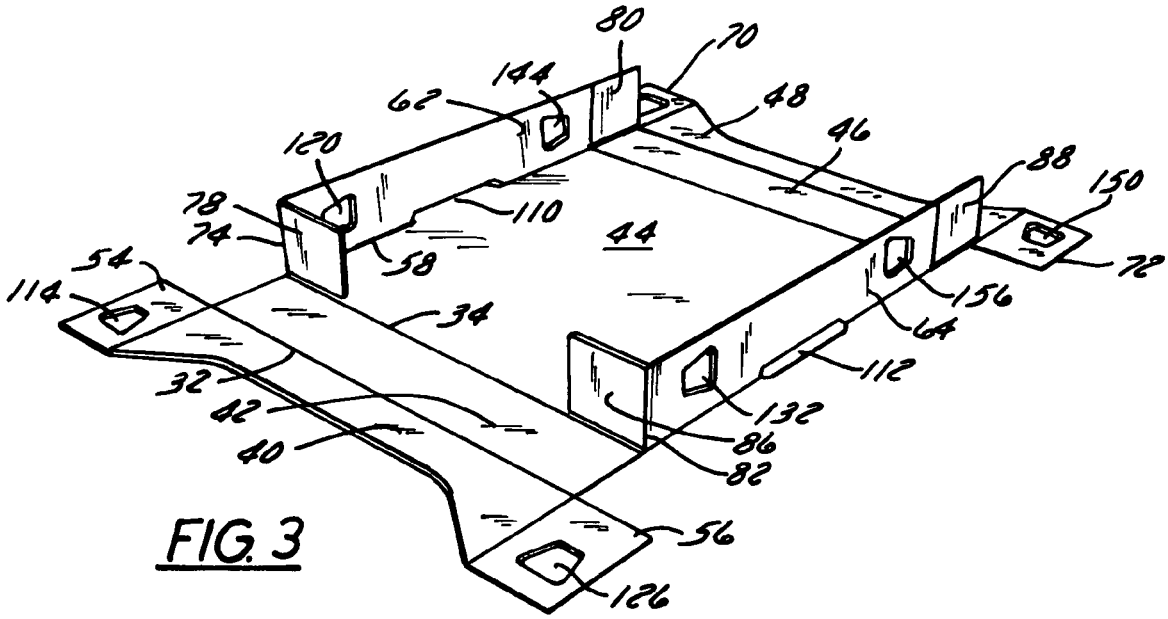
Figure 4:
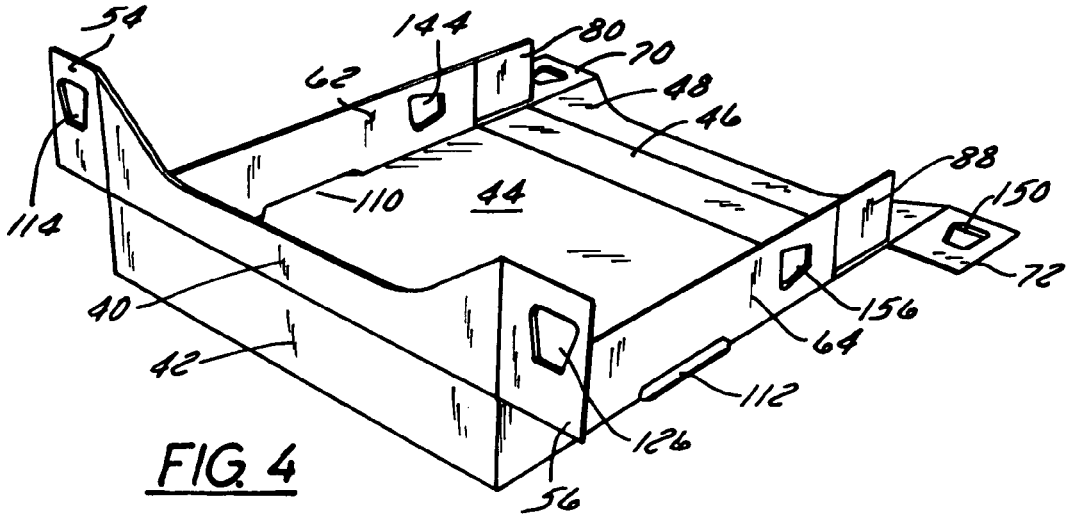
Figure 5:
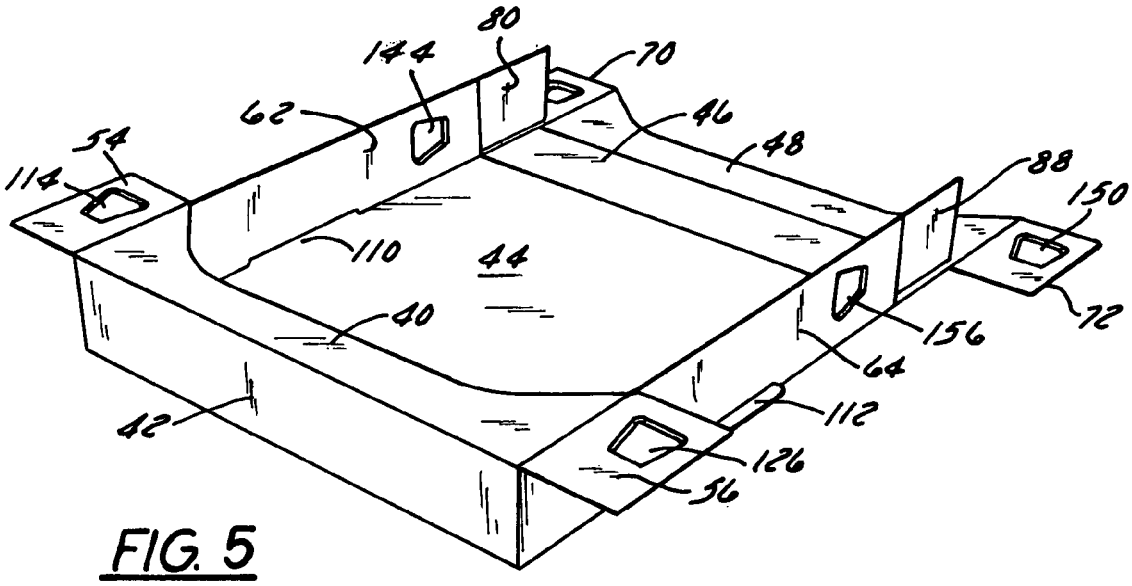
Figure 6:
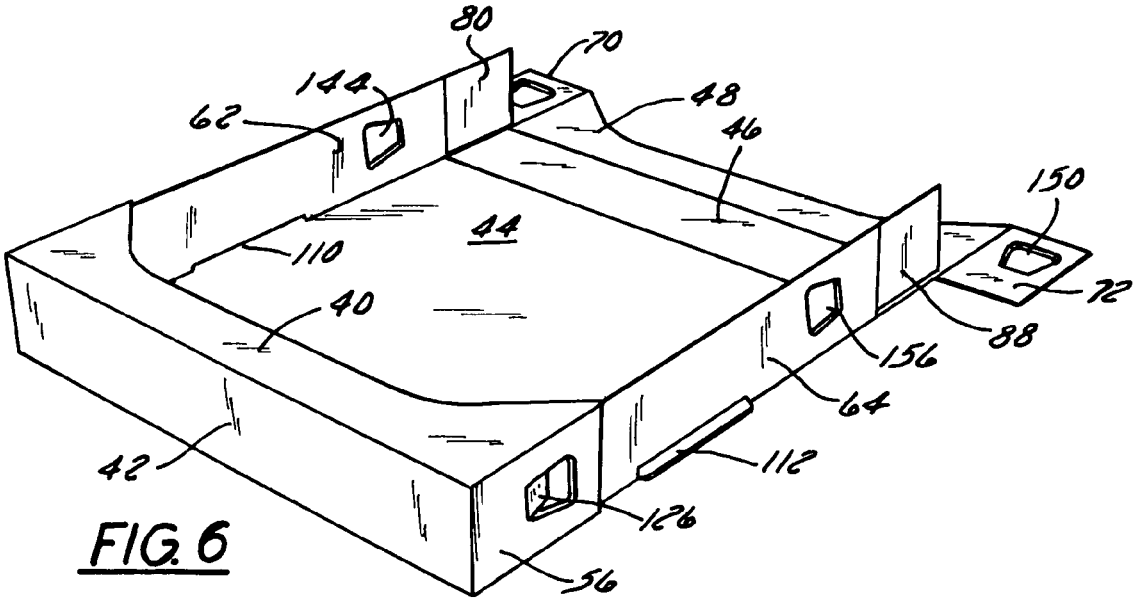

In FIG. 1, the blank 30 is divided by transverse parallel attachment lines 32, 34, 36 and 38 into a shoulder panel 40, a front panel 42, a bottom panel 44, a hack panel 46 and a shoulder panel 48. A pair of parallel longitudinal attachment lines 50 and 52 attach a pair of side flaps 54 and 56 to shoulder panel 40. A pair of parallel longitudinal attachment lines 58 and 60 attach a pair of side panels 62 and 64 to bottom panel 44. A pair of parallel longitudinal attachment lines 66 and 68 attach a pair of side flaps 70 and 72 to shoulder panel 48. A pair of transverse parallel attachment lines 74 and 76 attach front and back flaps 78 and 80 to the front and back sides of side panel 62. A pair of transverse parallel attachment lines 82 and 84 attach front and back flaps 86 and 88 to the front and back sides of side panel 64.

The front and back flaps are separated from adjacent flaps and panels by cut lines or slots. A pair of transverse cut lines or slots 90 and 92 separate, respectively, side flap 54 from front flap 78 and side flap 56 from front flap 86. A pair of parallel longitudinal cut lines or slots 94 and 96 separate, respectively, front panel 42 from front flap 78 and front panel 42 from front flap 86. A pair of parallel longitudinal cut lines or slots 98 and 100 separate, respectively, back panel 46 from back flap 80 and back panel 46 from back flap 88. A pair of transverse cut lines or slots 102 and 104 separate respectively, side flap 70 from back flap 80 and side flap 72 from back flap 88.

The attachment lines 50, 58 and 66 and the cut lines or slots 94 and 98 are substantially in alignment. The attachment lines 50 and 66 will be offset slightly outwardly of attachment line 58 to allow the flaps 54 and 70 to be on the outside of panel 62 in the formed container. The cut lines or slots 94 and 98 should be placed to allow the flaps 78 and 80 to be on the inner face of the front panel 42 and the back panel 46, respectively, in the formed container.

Similarly, the attachment lines 52, 60 and 68 and the cut lines or slots 96 and 100 are substantially in alignment. The attachment lines 52 and 68 are offset slightly outwardly of attachment line 60 to allow the flaps 56 and 72 to be on the outside of panel 64 in the formed container. The cut lines or slots 96 and 100 are placed to allow the flaps 86 and 88 to be on the inner face of the front panel 42 and the back panel 46, respectively, in the formed container.

The transverse attachment lines 74 and 82 are in substantial alignment with attachment line 34. The transverse attachment lines 74 and 82 are offset slightly inwardly of the attachment line 34 to allow the flaps 78 and 86 to be inside the front panel 42 in the formed container. The transverse attachment lines 76 and 84 are in substantial alignment with attachment line 36. The attachment lines 76 and 84 are offset slightly inwardly of the attachment line 34 to allow the flaps 78 and 86 to be inside the front panel 42 in the formed container.

There are attachment slots formed along the bottom of the container. These are formed by cut lines 106 and 108 located along the longitudinal attachment lines 58 and 60 and centrally of the side panels 62 and 64. The cut lines 106 and 108 are slightly offset from the attachment lines 58 and 60 and have ends that intersect the attachment lines 58 and 60 to form attachment slots 110 and 112 for the covers.

Consequently the term "in alignment" means the attachment lines and cut lines or slots will be in alignment or slightly offset depending of the placement of the panels and flaps in the formed container.

There are pairs of locking tabs formed in the side flaps attached to the shoulder panels and in the side panels. These are used to form the container and hold it in its erected form.

One pair of locking tabs is locking tab 114 formed in side flap 54 and locking tab 120 formed toward the front of side panel 62. Locking tab 114 is formed by cut lines 116 around three sides of the locking tab 114 and by attachment line 118 forming the fourth side of the locking tab 114. Locking tab 120 is formed by cut lines 122 around three sides of the locking tab 120 and attachment line 124 forming the fourth side of the locking tab 120.

Another pair of locking tabs is locking tab 126 formed in side flap 56 and locking tab 132 formed toward the front of side panel 64. Locking tab 126 is formed by cut lines 128 around three sides of the locking tab 126 and by attachment line 130 forming the fourth side of the locking tab 126. Locking tab 132 is formed by cut lines 134 around three sides of the locking tab 132 and attachment line 136 forming the fourth side of the locking tab 132.

Another pair of locking tabs is locking tab 138 formed in side flap 70 and locking tab 144 formed toward the back of side panel 62. Locking tab 138 is formed by cut lines 140 around three sides of the locking tab 138 and by attachment line 142 forming the fourth side of the locking tab 138. Second back locking tab 144 is formed by cut lines 146 around three sides of the locking tab 144 and attachment line 148 forming the fourth side of the locking tab 144.

Another pair of locking tabs is locking tab 150 formed in side flap 72 and locking tab 156 formed toward the back of side panel 64. Locking tab 150 is formed by cut lines 152 around three sides of the locking tab 150 and by attachment line 154 forming the fourth side of the locking tab 150. Locking tab 156 is formed by cut lines 158 around three sides of the locking tab 156 and attachment line 160 forming the fourth side of the locking tab 156.

In each of the pairs of locking tabs, the attachment lines are shown as facing each other. This is one embodiment. In the formed container, the locking tabs are congruent and the attachment lines of each pair are contiguous. Both attachment lines in the blank can be on facing sides as shown, or both can be on the top or bottom of the tab, or they can be opposed to each other. One tab in each tab pair is needed to lock the sides in place. An aperture can be used in place of the other tab in each locking tab pair.

The formation of the container is shown in FIGS. 2-7. The side panels 62 and 64 and their associated flaps 78, 80, 86 and 88 are bent upwardly around attachment lines 58 and 60. The flaps 78 and 86 are bent inwardly around their attachment lines 74 and 82. Front panel 42 and its attached shoulder panel and flaps 40, 54 and 56 are bent upwardly around attachment line 34 until the front panel 42 rests against the front sides of side panels 62 and 64. The shoulder panel 40 and its attached flaps 54 and 56 are bent downwardly around attachment line 32 until the shoulder panel rests on the upper edges of the side panels 62 and 64. Side flaps 54 and 56 are bent downwardly around attachment lines 50 and 52 until the flaps are against side panels 62 and 64. The locking tab 114 is now aligned with locking tab 120 with the attachment line 118 substantially contiguous with attachment line 124. The locking tab 126 is now aligned with locking tab 132 with the attachment line 130 substantially contiguous with attachment line 136. The pair of locking tabs 114 and 120 and the pair of locking tabs 126 and 132 are pushed into the container to lock the front panel 42, shoulder panel 40, side flaps 54 and 56, and side panels 62 and 64 in place.

Figure 7:
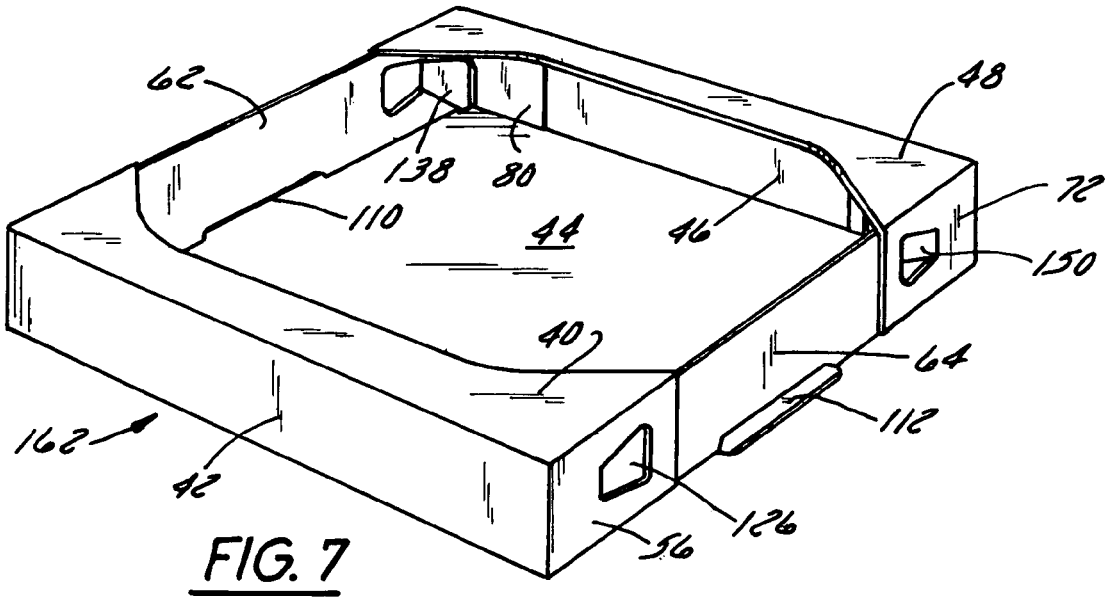
FIG. 7 is an isometric view of the pizza container assembled from the blank of FIG. 1.

The product is placed within the container. The flaps 80 and 88 are bent inwardly around their attachment lines 76 and 84. The back panel 46 and its associated shoulder panel 48 and flaps 70 and 72 are bent upwardly around attachment line 36 until the back panel rests against the back sides of side panels 62 and 64. The shoulder panel 48 and its associated flaps 70 and 72 are bent downwardly around attachment line 38 until the shoulder panel 48 rests on the top edges of side panels 63 and 64. The flaps 70 and 72 are bent downwardly around attachment lines 66 and 68 until the flaps are against the sides of side panels 62 and 64. The locking tab 138 is now aligned with locking tab 144 with the attachment line 142 substantially contiguous with attachment line 148. The locking tab 150 is now aligned with locking tab 156 with the attachment line 154 substantially contiguous with attachment line 160. The pair of locking tabs 138 and 144 and the pair of locking tabs 150 and 156 are pushed into the container to lock the back panel 46, shoulder panel 40, side flaps 70 and 72, and side panels 62 and 64 in place. The formed container 162 is shown in FIG. 7.

Figure 8:
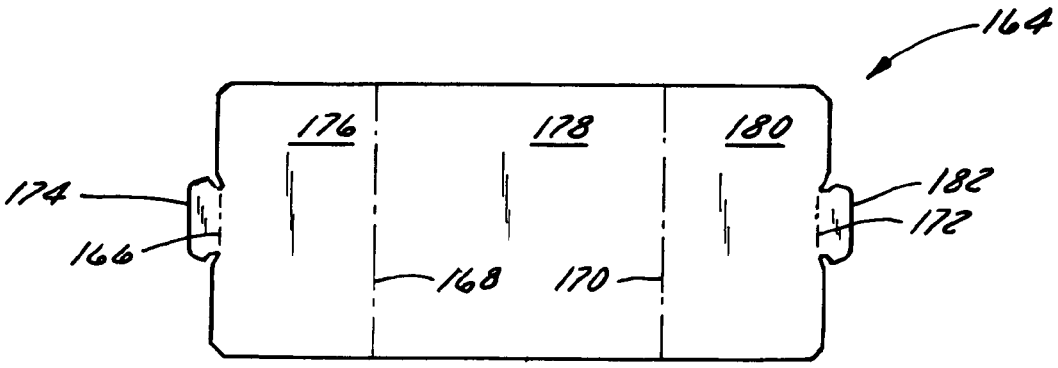
FIG. 8 is a top plan view of a blank for a cover for a stack of three pizza containers.

FIG. 8 shows a blank for a cover for a stack of 3 containers. The blank 164 of the cover 184 is divided by parallel transverse cover attachment lines 166, 168, 170 and 172 into a cover attachment flap 174, a cover side panel 176, a cover top panel 178, a cover side panel 180 and a cover attachment flap 182.

FIGS. 9-12 show the formation and covering of a three high stack of containers. The three containers 162, 162*a* and 162*b* are filled and stacked. Each of the upper containers in the stack rest on the shoulder panels of the container below it. The cover 184 is placed on the top container in the stack with the cover top panel 178 overlying the top of the upper container 162*b* and resting on the shoulder panels of the upper container 162*b*. The cover side panels 176 and 178 are bent downwardly around their attachment lines 168 and 170. The cover attachment flaps 174 and 182 are bent inwardly around attachment lines 166 and 172 and pushed through the attachment slots 10 and 112 of the bottom container 162.

A single cover 184 is used for three containers and uses less material than if there were a cover on each of the three containers. Only one top panel is required in place of three top panels in a standard container. The height of each of the side panels 176 and 180 is the height of three containers. The amount of material used is less than for three standard containers, each of which usually has a top cover and side flaps extending into the container from three sides of the top cover.

Figure 13:
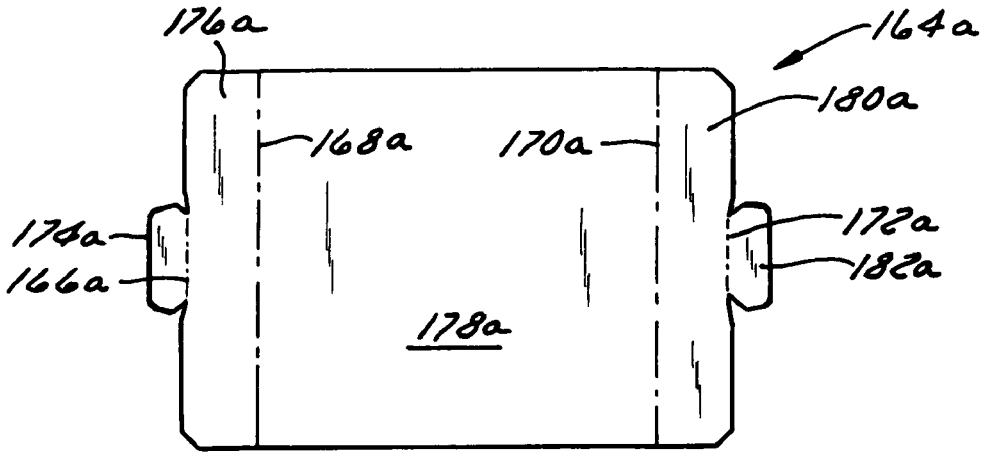
FIG. 13 is a top plan view of a blank for a cover for a single pizza container.
Figure 14:
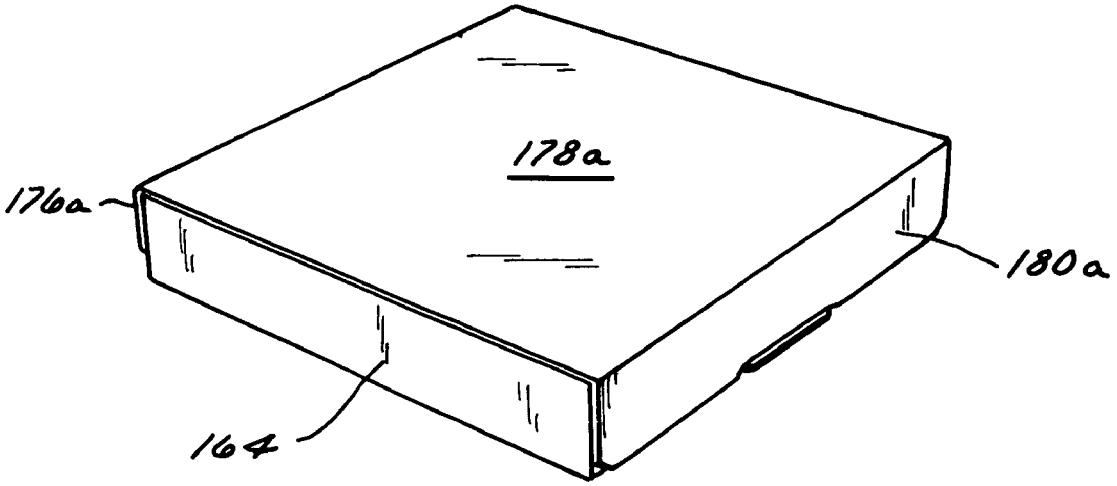
FIG. 14 is an isometric view of a single pizza container with the cover in place.

FIG. 13 shows a blank 164*a* for a cover for a single container. It has the same design as the blank for a three high stack of containers and like reference numerals are used. FIG. 14 shows the cover 184*a* in place by a container 164 with the attachment flaps 174*a* and 182*a* bent inwardly and pushed through attachment slots 110 and 112. The top panel 178*a* rests on the shoulder panels of the container 164. The height of each of the side panels 176*a* and 180*a* is the height of one container. The amount of material used is about the same as for a standard single container.

Figure 15:
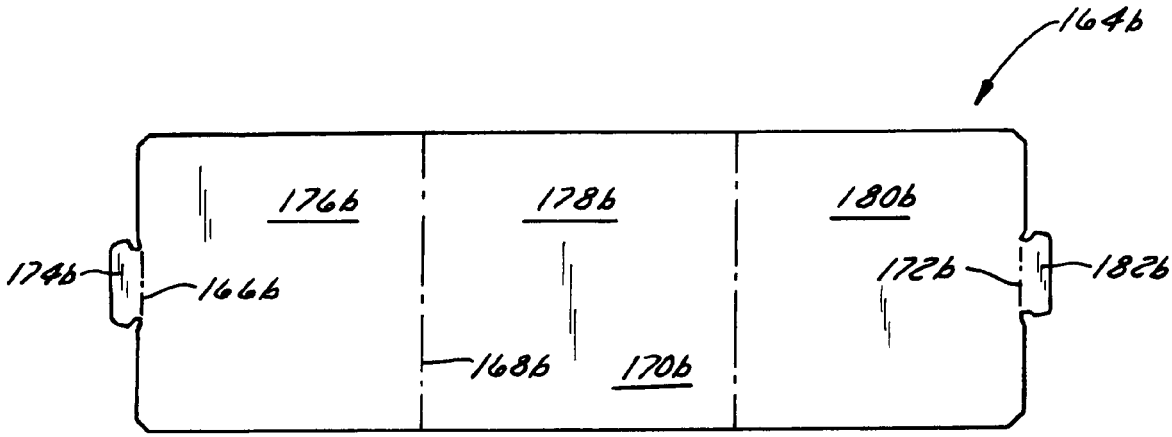
FIG. 15 is a top plan view of a blank for a cover for a stack of five pizza containers.
Figure 16:
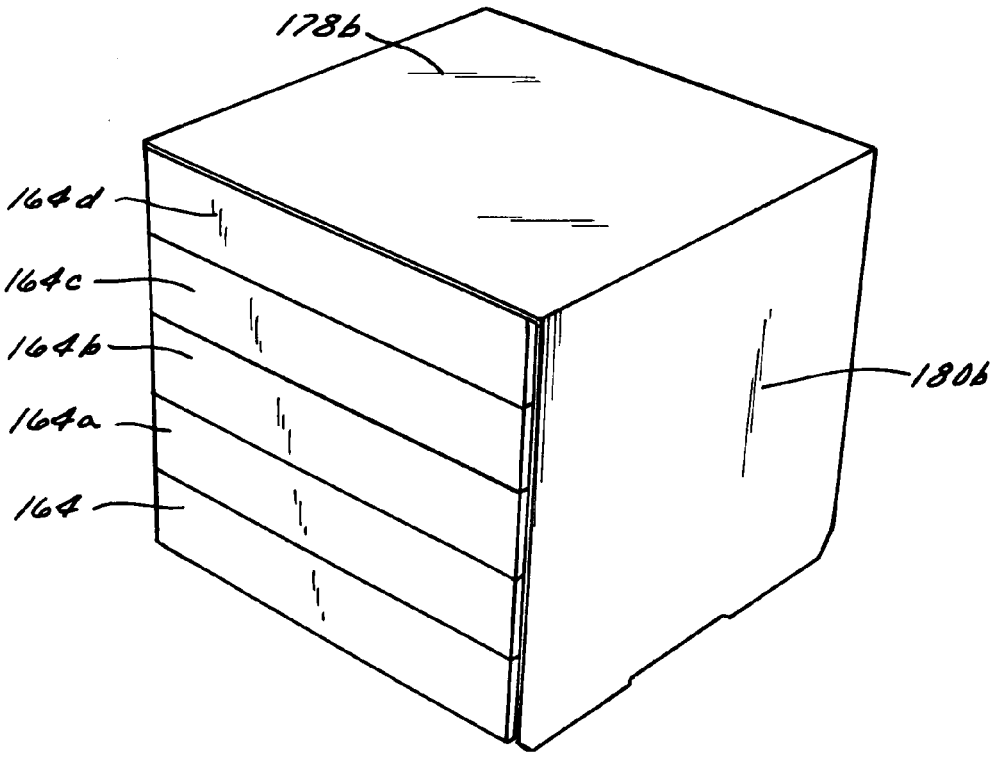
FIG. 16 is an isometric view of a stack of five pizza boxes with the cover in place.

FIG. 15 shows a blank 164*b* for a cover for a stack of five containers. Again, it has the same design as the blank for a three high stack of containers and like reference numerals are used. FIG. 16 shows the cover 184*b* in place on a stack of five containers 164, 164*a*, 164*b*, 164*c* and 164*d*. The attachment flaps 174*b* and 182*b* are bent inwardly and pushed through attachment slots 110 and 112 of the bottom container 164. The top panel 178*b* rests on the shoulder panels of the top container 164*d*. The height of each of the side panels 176*b* and 180*b* is the height of five containers. The amount of material used is less than for five standard containers.

Figure 17:
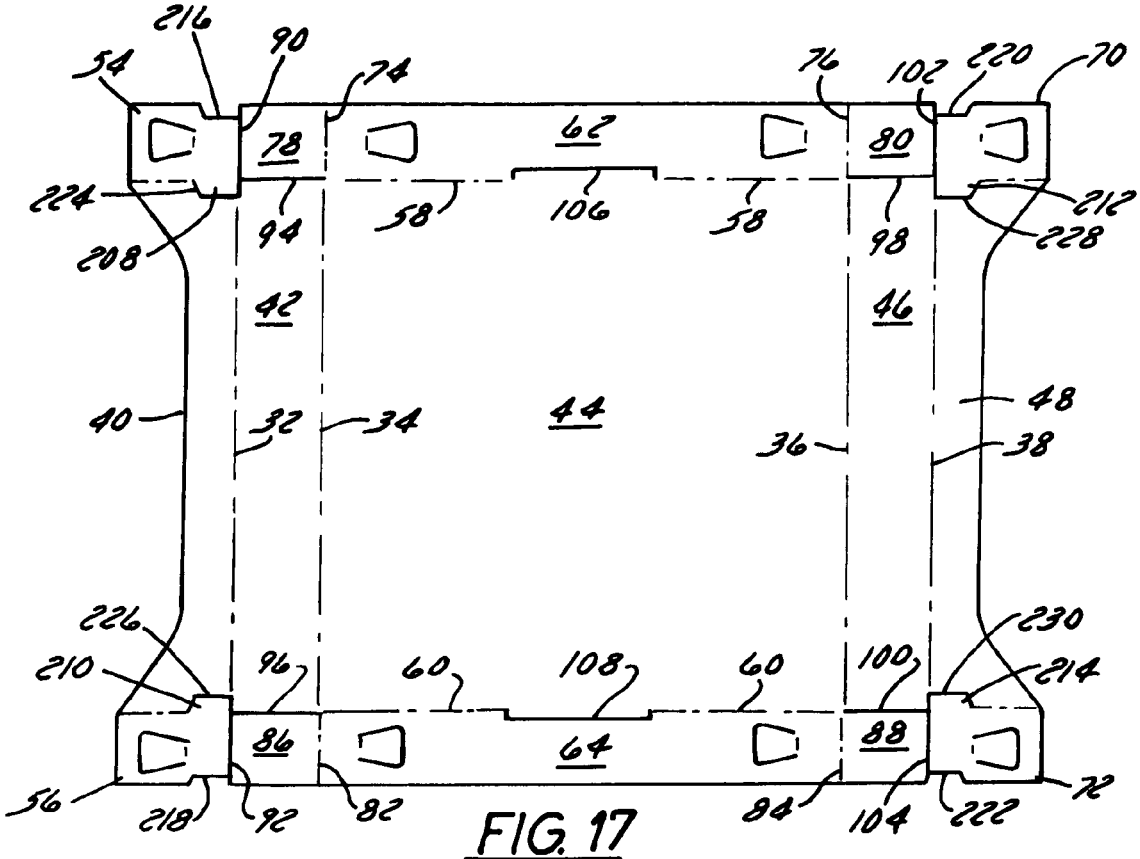
FIG. 17 is a top plan view of the blank of another embodiment of a pizza container.
Figure 18:
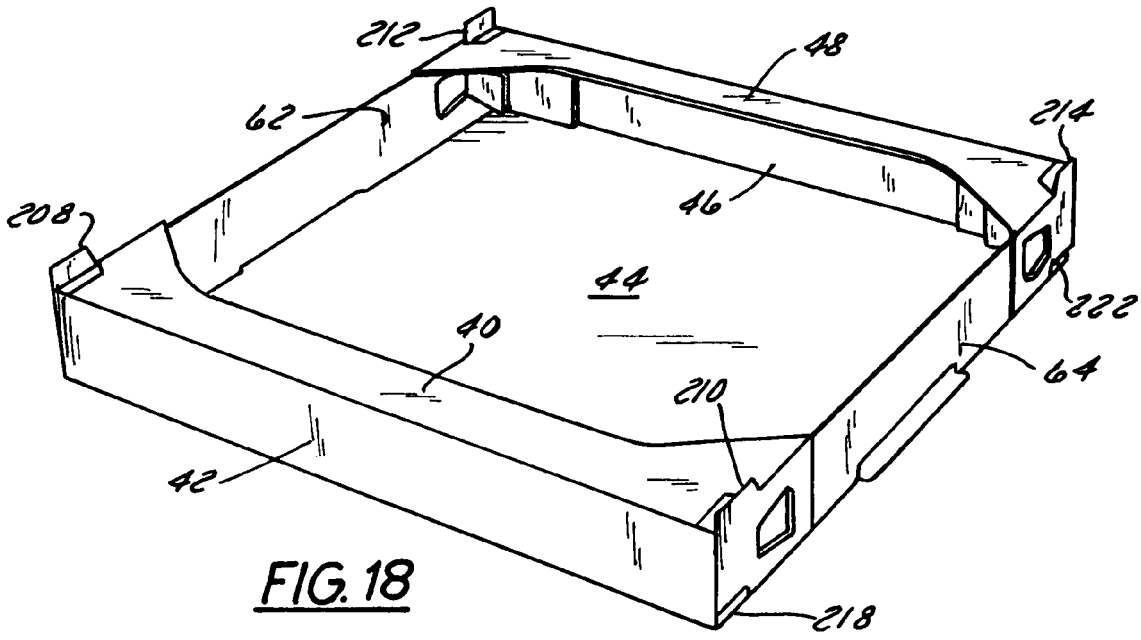
FIG. 18 is an isometric view of the pizza container assembled from the blank of FIG. 17.

FIG. 17 shows another embodiment of the container. The only difference between this blank and the blank of FIG. 1 are the four corner stacking tabs 208, 210, 212 and 214 and the four corresponding cut-outs 216, 218, 220 and 222 on the side flaps 54, 56, 70 and 72. The stacking tabs are formed by cut lines 224, 226, 228 and 230 which extend into first and second shoulder panels 40 and 48. Otherwise the same reference numerals that are used for FIG. 1 are used for this blank. FIG. 18 shows the formed container. It is formed the same way as shown and described in FIGS. 2-7.

Figure 9:
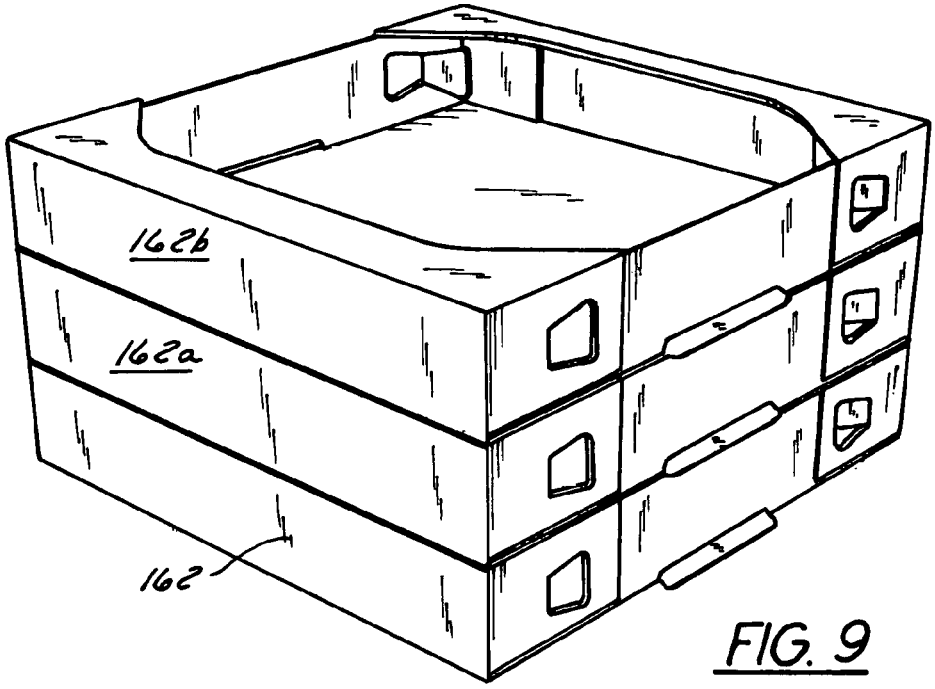
FIGS. 9-12 are isometric views showing the assembly of a cover on a stack of three pizza boxes.
Figure 19:
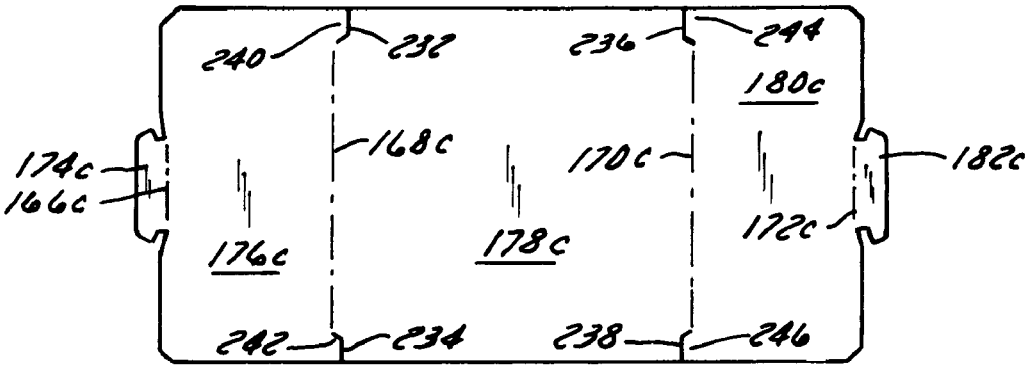
FIG. 19 is a top plan view of a blank for a cover for a stack of three pizza containers of the embodiment shown in FIGS. 17 and 18.
Figure 20:
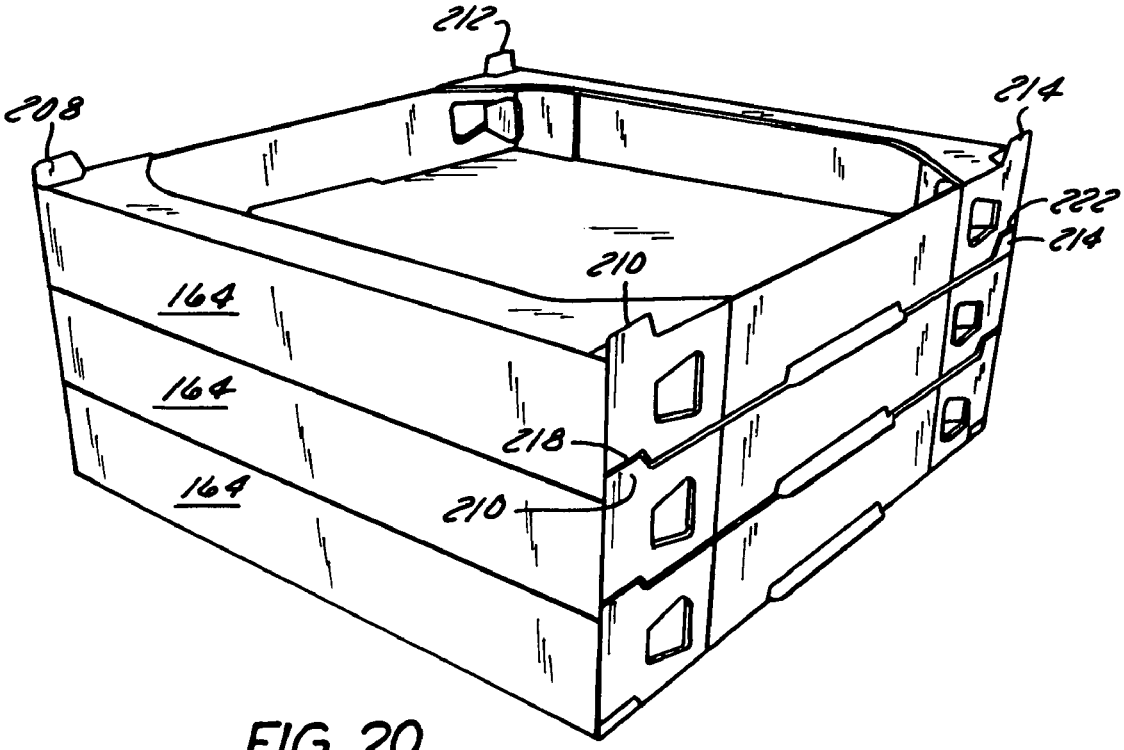
FIGS. 20-24 are isometric views showing the assembly of a cover on a stack of three pizza containers of the embodiment shown in FIGS. 17 and 18.
Figure 21:
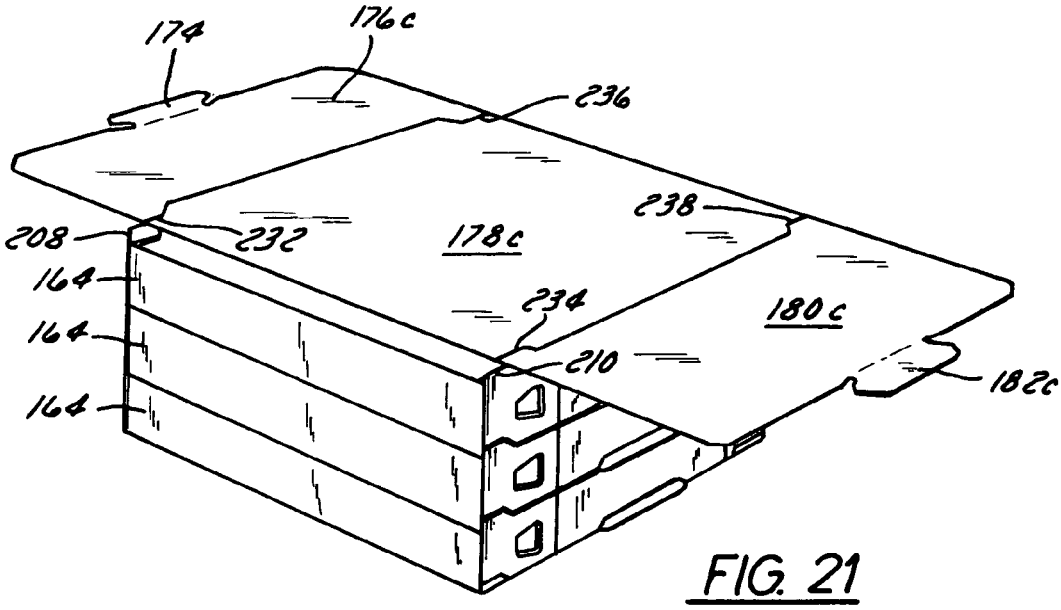
Figure 22:
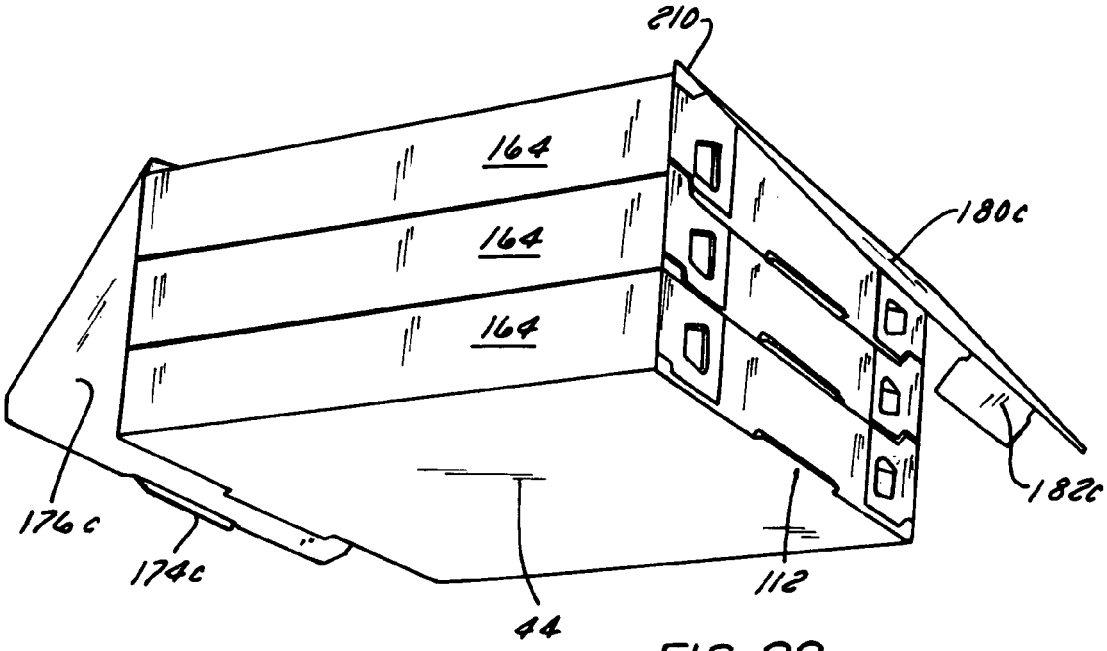
Figure 23:
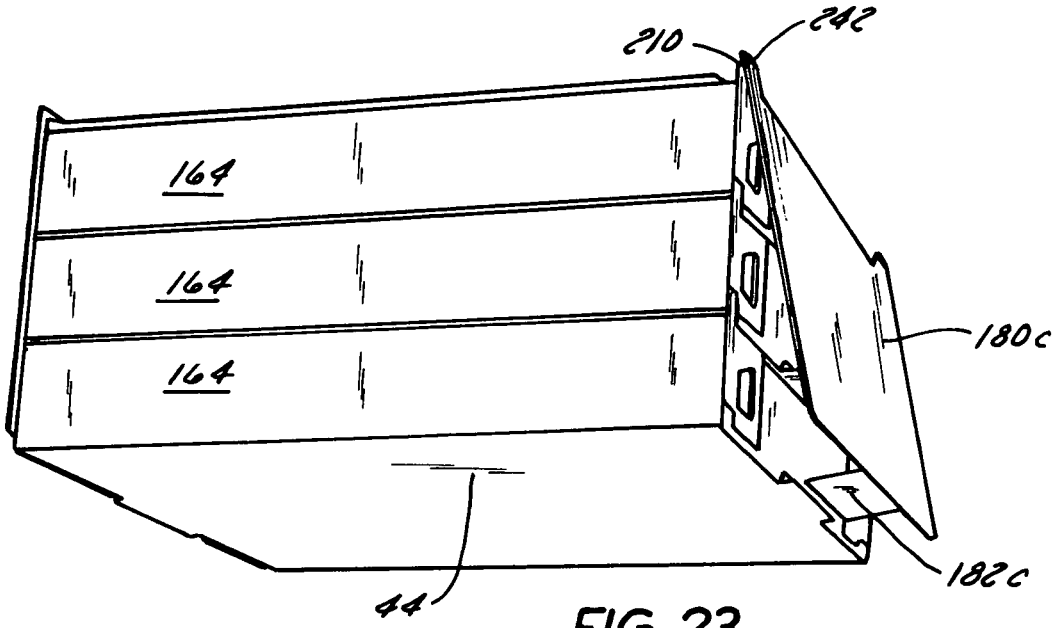
Figure 24:
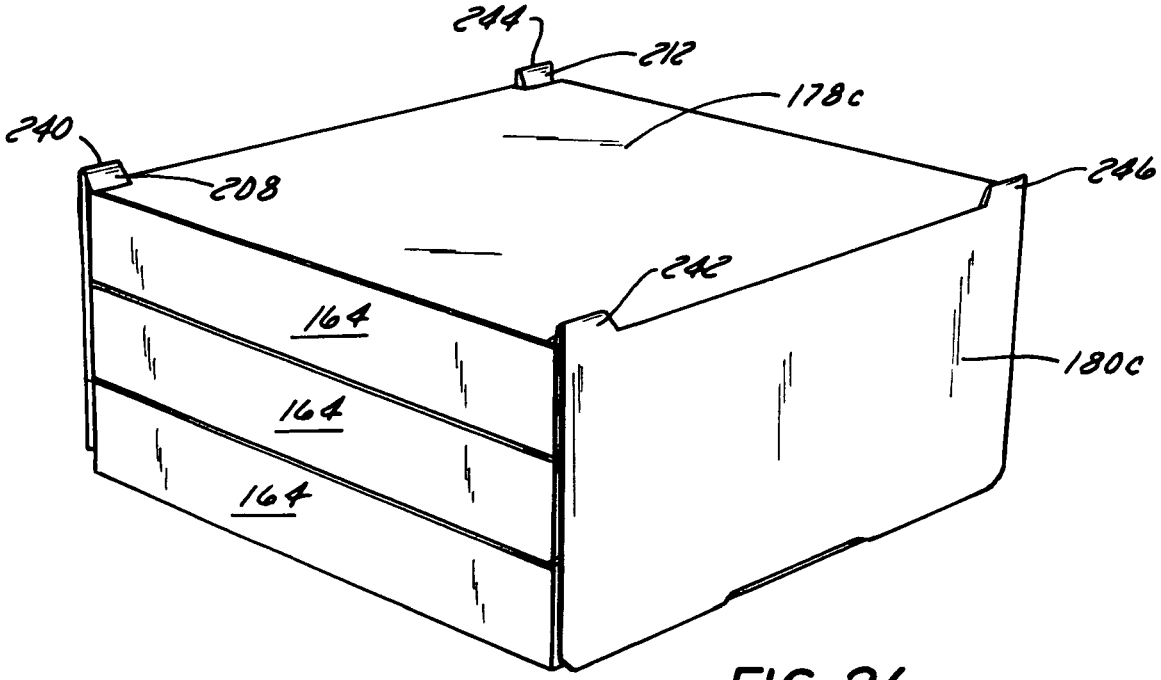

FIG. 19 shows a blank for a cover for a stack of the containers. The only difference between this blank and the blank shown in FIG. 9 are the cut-outs 232, 234, 236 and 238 in the top panel to accommodate the stacking tabs of the top container and form tabs 240, 242, 244 and 246. Again this cover can be sized for any number of containers from one container to a stack of any number of containers.

Figure 10:
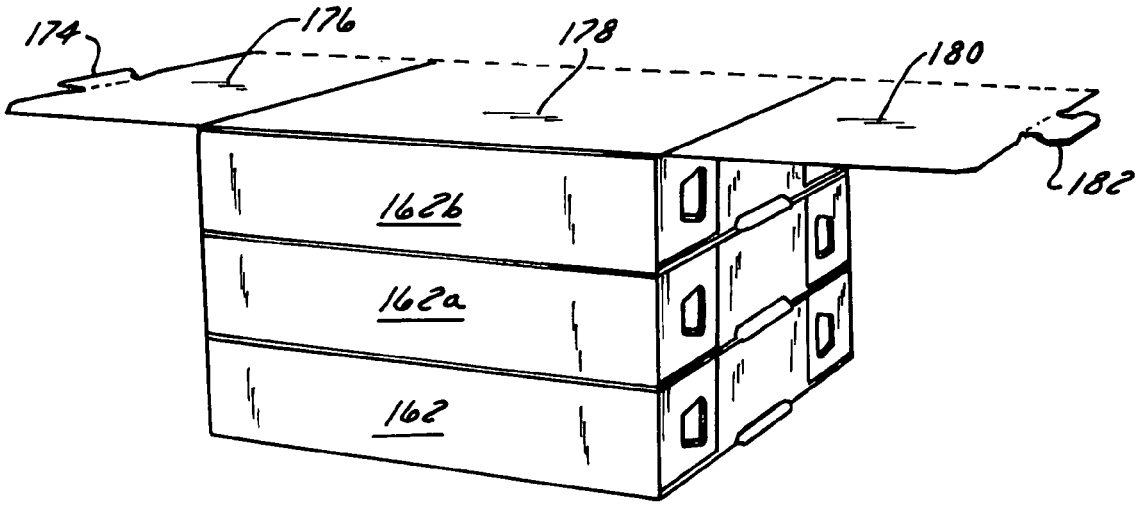
Figure 11:
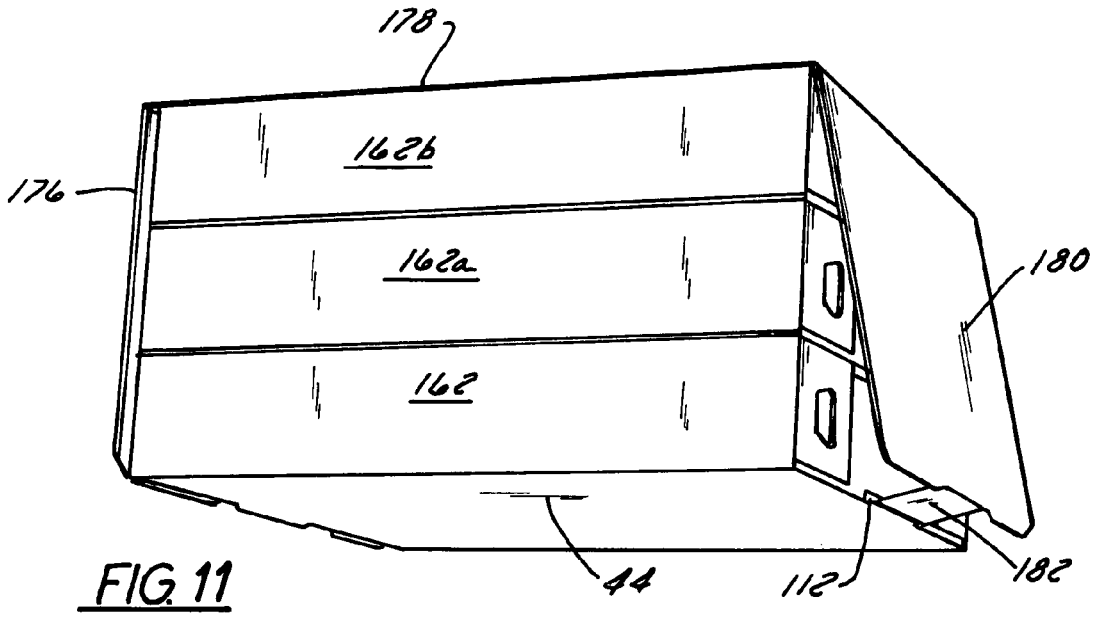
Figure 12:
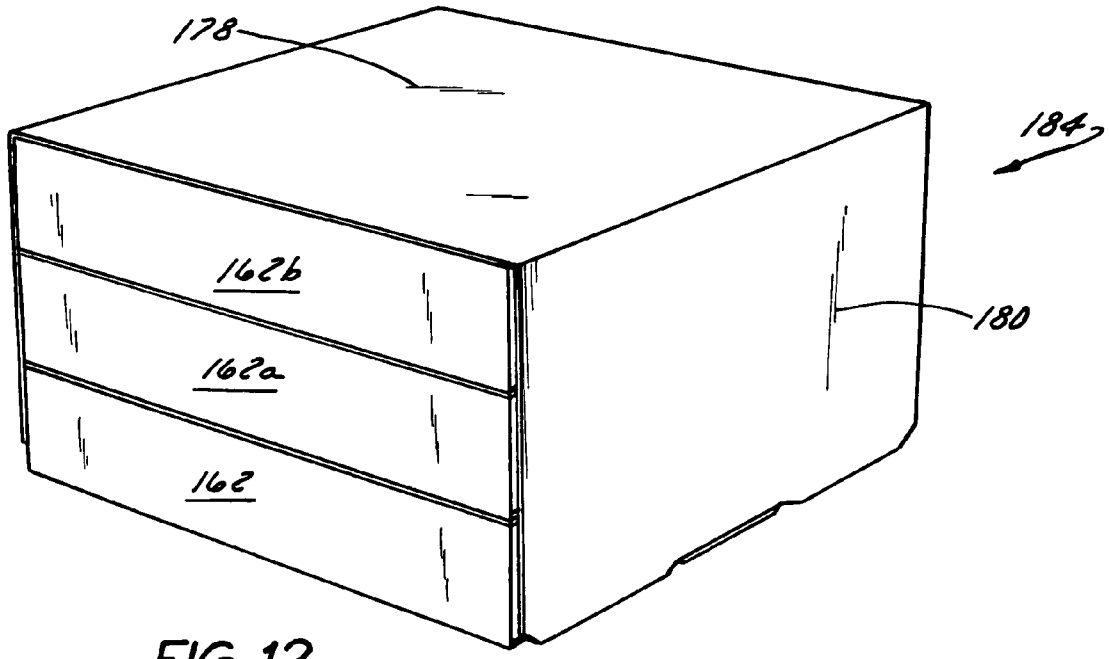

As can be seen in FIGS. 20-24 the containers are stacked and the cover is placed on the containers in the same manner as was described in the discussion of FIGS. 10-12. The stacking tab fits into the cut-out above it.

The package is described as being used for pizzas but may be used for other products.

The package may be made with corrugated board, containerboard or fiberboard, or combinations of these.

Other modifications can be made without departing from the spirit of the invention.

The invention claimed is:

1. A container, comprising:

a bottom wall having opposite end edges and opposite side edges;

a side wall foldably joined to each of said side edges and extending upwardly therefrom, said side walls having top and bottom edges and opposite ends;

a flap on each end of each said side wall, said flaps being folded inwardly perpendicular to the respective associated side wall to lie parallel to a respective adjacent end edge of said bottom wall;

cut outs (120, 132, 144, 156) in each said side wall adjacent but spaced from each end thereof and spaced from said top and bottom edges thereof;

an end wall foldably joined to each end edge of said bottom wall and extending upwardly therefrom to lie against an outer surface of said flaps on said side walls, each said end wall having an upper edge;

a shoulder panel foldably joined to said upper edge of each said end wall and extending inwardly therefrom in spaced parallel relationship over said bottom wall;

a side flap foldably connected to each end of each said shoulder panel, said side flaps being folded downwardly to lie against an outer surface of respective adjacent ends of said side walls in overlying relationship to said cut outs in said side walls;

a locking tab (114, 126, 138, 150) formed in each said side flap spaced from adjacent edges of respective said side flaps, said locking tabs being inserted through said cut outs to lock said side flaps and thus said shoulder panels, end walls and side walls in operative folded relationship;

a cut (106, 108) in each said side wall at its bottom edge forms a slot (110, 112) immediately above an upper surface of said bottom wall to receive respective cover attachment flaps (174, 182);

a separate cover (164) is applied to said container, said cover comprising a cover top panel lying on top of said shoulder panels in parallel spaced relationship to said container bottom wall, and cover side panels depending from opposite side edges of said cover top panel to overlie a respective said side wall; and the cover attachment flap on a bottom edge of each said cover side panel is folded inwardly and extends through a respective said slot at the bottom edge of each said side wall to hold said cover in place.

2. A container as claimed in claim 1, wherein:

a plurality of said containers are stacked on top of one another with the bottom wall of an upper container resting on the shoulder panels of a lower container; and said cover top panel overlies the uppermost container in said stack, and said side panels have a length to extend to the bottom of the lowermost container in said stack, said cover attachment flaps being inserted in the slots in the lowermost container to hold the stack of containers and the cover in place.

3. A container as claimed in claim 1, wherein:

a cut adjacent and parallel to the folded connection between said shoulder panels and said side flaps forms a stacking tab on an upper edge of each said side flap, a said stacking tab projecting upwardly beyond said shoulder panels at each corner of said container; and a cut out is in a bottom edge of each side flap in position to be in registry with and receive a stacking tab on a subjacent container when the containers are stacked on top of one another.

4. A container as claimed in claim 3, wherein:

a separate cover is applied to said container, said cover comprising a cover top panel lying on top of said shoulder panels in parallel spaced relationship to said container bottom wall, and cover side panels foldably connected to opposite side edges of said cover top panel and depending therefrom to overlie a respective said side wall;

a cover attachment flap on a bottom edge of each said cover side panel is folded inwardly and extends through a respective said slot at the bottom edge of each said side wall to hold said cover in place; and cuts in opposite edges of said cover in closely spaced parallel relationship to the folded connection between said cover top panel and said cover side panels form slits for receiving said stacking tabs.

5. A container as claimed in claim 4, wherein:

a plurality of said containers are stacked on top of one another with the bottom wall of an upper container resting on the shoulder panels of a lower container; and said cover top panel overlies the uppermost container in said stack, and said side panels have a length to extend to the bottom of the lowermost container in said stack, said cover attachment flaps being inserted in the slots in the lowermost container to hold the stack of containers and the cover in place.

6. In combination, a plurality of containers stacked on top of one another, and a single separate cover applied over said stack of containers, wherein:

said containers each comprise a bottom wall having opposite side edges and opposite end edges, side walls extending upwardly from said side edges, end walls extending upwardly from said end edges, and shoulder panels extending in parallel spaced relationship to said bottom wall from upper edges of said end walls; and said cover comprises a top panel overlying the uppermost container in said stack, and side panels extending from opposite side edges said top panel to the bottom of the lowermost container in said stack in overlying relationship to said container side walls;

a slot is formed in each container side wall at its bottom edge;

a cover attachment flap on a bottom edge of each said cover side panel is folded inwardly and inserted through a respective said slot at the bottom edge of each said side wall to hold said cover in place;

a stacking tab projects upwardly from each corner of each said container; and said cover top panel has cut outs to receive the stacking tabs of the uppermost container in said stack of containers.

* * * * *